US006623349B2

(12) United States Patent
Fletcher

(10) Patent No.: US 6,623,349 B2
(45) Date of Patent: Sep. 23, 2003

(54) CURRENCY HANDLING APPARATUS

(75) Inventor: Paul Robert Fletcher, Camberley (GB)

(73) Assignee: Mars, Incorporated, McLean, VA (US)

( * ) Notice: Subject to any disclaimer, the term of this patent is extended or adjusted under 35 U.S.C. 154(b) by 10 days.

(21) Appl. No.: 09/921,964

(22) Filed: Aug. 3, 2001

(65) Prior Publication Data

US 2002/0037696 A1 Mar. 28, 2002

(30) Foreign Application Priority Data

Aug. 10, 2000 (EP) ..... 00306848

(51) Int. Cl.[7] ..... G07D 9/00
(52) U.S. Cl. ..... 453/17; 453/2
(58) Field of Search ..... 453/17, 16, 20, 453/2

(56) References Cited

U.S. PATENT DOCUMENTS 4,491,140 A * 1/1985 Eglise et al. ..... 453/17
4,587,984 A * 5/1986 Levasseur et al. ..... 453/17
4,883,158 A * 11/1989 Kobayashi et al. ..... 194/217
5,380,242 A * 1/1995 Matsumoto et al. ..... 453/3
5,499,944 A * 3/1996 Weston et al. ..... 453/17
5,885,151 A * 3/1999 Weston et al. ..... 453/17
5,997,396 A * 12/1999 Itako ..... 453/17

FOREIGN PATENT DOCUMENTS

| | | | |
|---|---|---|---|
| EP | 0 076 640 A1 | 4/1983 | ..... G07F/5/24 |
| EP | 0 986 031 A1 | 3/2000 | ..... G07F/5/24 |
| WO | WO 94/03874 | 2/1994 | ..... G07F/5/24 |
| WO | WO 95/14290 | 5/1995 | ..... G07F/5/24 |
| WO | WO 98/58355 | 12/1998 | ..... G07F/5/00 |

* cited by examiner

*Primary Examiner*—Donald P. Walsh
*Assistant Examiner*—Mark J. Beauchaine
(74) *Attorney, Agent, or Firm*—Fish & Richardson P.C.

(57) ABSTRACT

A currency handling apparatus is arranged to perform a float operation at the end of which a store holds coins of various denominations in appropriate quantities such that their collective value is equal to a predetermined value, wherein the respective proportions of the different denominations may vary depending upon various conditions.

15 Claims, 2 Drawing Sheets

FIG. 2
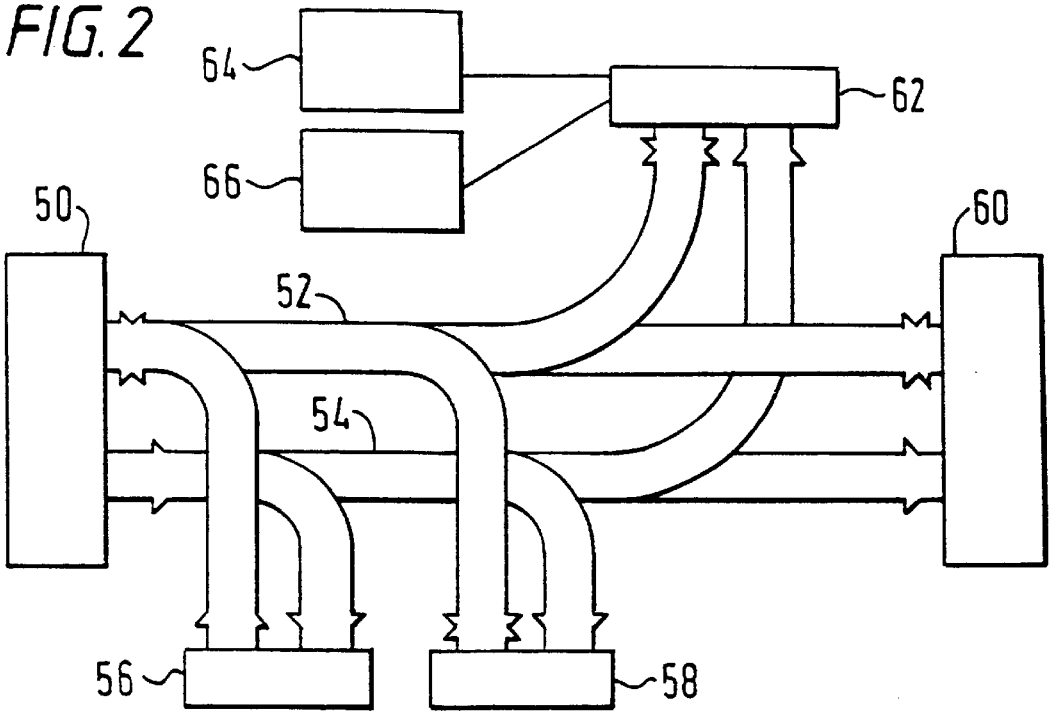
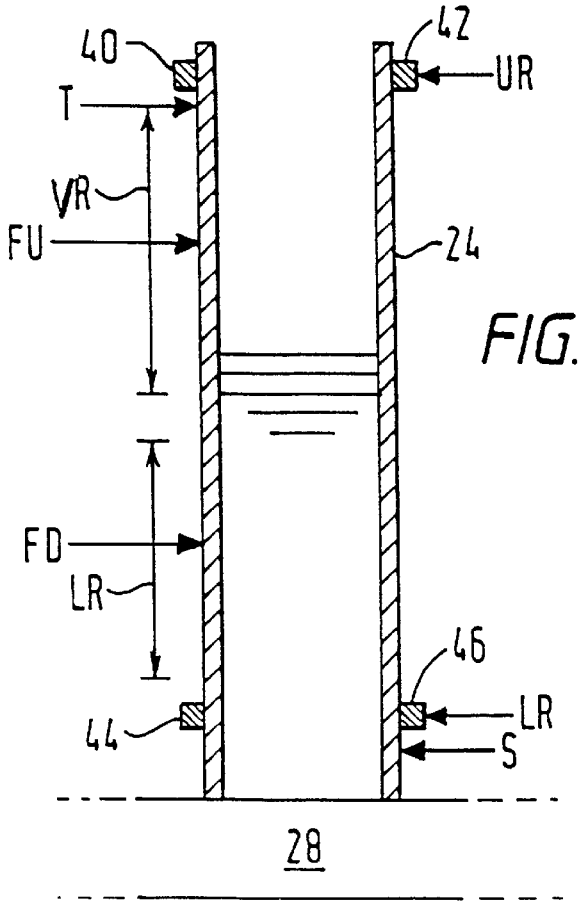
FIG. 3

CURRENCY HANDLING APPARATUS

This invention relates to apparatus for handling units of currency. The invention will be described mainly in the context of coin handling, but is also applicable to apparatus which also or alternatively handles other units of currency, such as banknotes.

It is known to provide a coin handling apparatus which receives and validates coins of different denominations, and directs valid coins to respective containers each containing coins of a single denomination. It is also known to dispense coins from these containers as change in an amount corresponding to the difference between the value of inserted coins and the price of a product or service obtained from a machine associated with the coin handling apparatus.

It is also known to arrange for the level of coins in each container not to exceed a predetermined upper level. The apparatus would thus tend to direct coins of a particular denomination to an associated container until the upper level is reached, and then any further coins of the same denomination would be sent to a cashbox, which would normally be of a type which does not permit the dispensing of coins therefrom.

Periodically, an operator will empty the cashbox. At this time, it is common for operators to adjust the levels of coins in the coin containers so that each one will contain a number of coins corresponding to a so called "float" level for the respective container. Adjustable markers may be provided to indicate these float levels.

An apparatus of this type substantially continuously stores large amounts of currency in the containers. This ensures that there is usually an adequate supply of coins in the container to be used as change if this is necessary. The float levels may be decreased to release cash to the machine owner, but then less cash is available for giving change to a user of the machine, and therefore there is a greater risk that insufficient change will be available, or at least that a potential short-change situation is reached, resulting in an "exact-change" warning being given, which may deter potential customers.

The present invention aims to improve these known arrangements.

WO-A-94/03874 discloses an arrangement for automatically calculating float levels for respective denominations. The float levels are individually determined in accordance with expected requirements for providing change. The described apparatus can operate in two different modes. In one mode, the "float up" mode, each float level corresponds to an adjustable maximum level for the respective container. The float operation involves filling each container (possibly from coins in the cashbox) until the maximum level is reached, any further coins then being automatically directed to the cashbox rather than the container. The maximum levels of the coins in the containers are adjusted in accordance with expected change requirements, and are likely to be fairly high, so the float operation results in a large number of coins being retained in the machine. The "float down" mode involves calculating float levels which would normally be lower than the maximum number of coins stored in the containers during operation of the apparatus. The float operation involves the machine automatically dispensing coins from each container until the float down level is reached (if necessary after first replenishing any containers whose contents are lower than the float level).

According to an aspect of the present invention, a currency handling apparatus is able to calculate individual float levels for respective denominations in such a way that the total value of the currency units left after a float operation is equal to a predetermined (and preferably alterable) value. The apparatus of the preferred embodiment includes a control means which is capable of determining different combinations of denominations each of which has a collective value equal to the predetermined value, but for a given set of conditions the control means would determine a single combination to be left after the float operation, in accordance with predetermined criteria.

It is intended that, in the preferred embodiment, a serviceman would periodically empty the apparatus, by operating a control means to empty the or each store to the respective float levels (which in the preferred embodiment causes the emptied currency units to be delivered to a cashbox, and then the serviceman would empty the cashbox itself). A large amount of cash can therefore be removed from the machine without requiring careful adjustment operations by the serviceman, with the consequent possibility of errors. If any store needs replenishing to reach the float level, the serviceman preferably does this using coins from the cashbox. To aid him, the apparatus preferably has an indicator to show that replenishment is required, and preferably which stores and/or denominations need replenishing. After the float operation, the stores are replenished during normal use of the machine.

Using an arrangement according to the present invention, the machine owner can be confident of the total amount of money contained in his machines following float operations, but nevertheless there is the flexibility to adjust the relative proportions of the different denominations stored in the machines.

It is envisaged that this flexibility would be used to provide similar advantages to those described in WO-A-94/03874, in that the float levels for the respective denominations can be individually adjusted to suit expected change requirements. However, using the techniques of the present invention, it is possible to achieve this while (a) setting an overall limit to the amount of cash retained in the machines, (b) avoiding uncertainty regarding the amount of cash left in the machines following float operations, and (c) avoiding difficulties in reconciling records of the cash taken from and stored in the machines.

As explained in WO-A-94/03874, it has been found that it is possible, by arranging for the apparatus to monitor certain parameters, to calculate dynamically the likelihood that a particular denomination will be required for dispensing. This monitoring operation can be used in determining the relative quantities of respective denominations to be retained as a result of the float operation.

The monitored parameters may include data indicative of the relative populations of currency of different denominations, either throughout the country in which the apparatus is being used or in a local region in which the apparatus is used. Denominations which are more numerous will be more likely to be inserted into the apparatus and less likely to be needed in large quantities as change in the period immediately after servicing the machine.

The parameters may also take into account the prices of products vended or services performed in exchange for cash received by the apparatus. If for example the price of a product is slightly less than a unit of currency, there is a substantial likelihood that the apparatus will be required to pay out the difference in change. The parameters may also take into account the relative popularity of different products or services.

As a more direct indication of the likely need for change, the parameters may include data representing the rate at which currency units are received by the machine and/or the rate at which currency units are dispensed by the machine. The difference between these two numbers for a particular denomination indicates whether currency of that denomination are likely to be dispensed from or delivered to the respective store.

The parameters may additionally or alternatively relate to the way in which currency units of a particular denomination have been handled, e.g. whether they have been predominantly routed to the cashbox or to a store. This will vary depending upon whether the store is tending either to stay full or to be frequently depleted by providing change.

Thus, a preferred embodiment may be arranged to use any one or more of the following parameters:

(a) the set of denominations which can be accepted by the apparatus;

(b) the set of denominations which can be dispensed by the apparatus;

(c) data indicative of the relative population levels of respective currency denominations in the area in which the apparatus is to be used;

(d) the number of currency units of respective denominations which have been received by the apparatus;

(e) the number of currency units of respective denominations which have been dispensed by the apparatus;

(f) the way in which currency units of particular denominations have been routed by the apparatus;

(g) price data representative of the price of products or services obtained by supplying currency units to said apparatus; and (h) detection of "insufficient change" situations, wherein the apparatus cannot dispense adequate change because of depletion of one or more denominations.

It will be noted that these parameters are interrelated. Any other monitorable parameter bearing a direct or indirect relationship to one or more of these parameters may be used. It will be noted also that by monitoring these parameters, the apparatus can respond to changes in them, e.g. changes in the acceptance coin set or the dispense coin set, changes in local conditions, etc.

Instead of selecting a combination of units in order to improve change availability, the present invention can be used to achieve an alternative advantage. The arrangement may be such that the individual float levels are set so as to minimise the number of coins which would be needed to be added to the containers in order to reach the float levels, and/or minimise the number of coins that need to be dispensed from the containers to reach the float levels. The object would be to reduce the amount of time which needs to be spent by the serviceman in performing the float operation.

An arrangement embodying the invention will now be described by way of example with reference to the accompanying drawings, in which:

FIG. 2 is a block diagram of the circuit of the coin handling apparatus; and FIG. 3 is a diagram of one of the containers of the apparatus.

Figure 1:
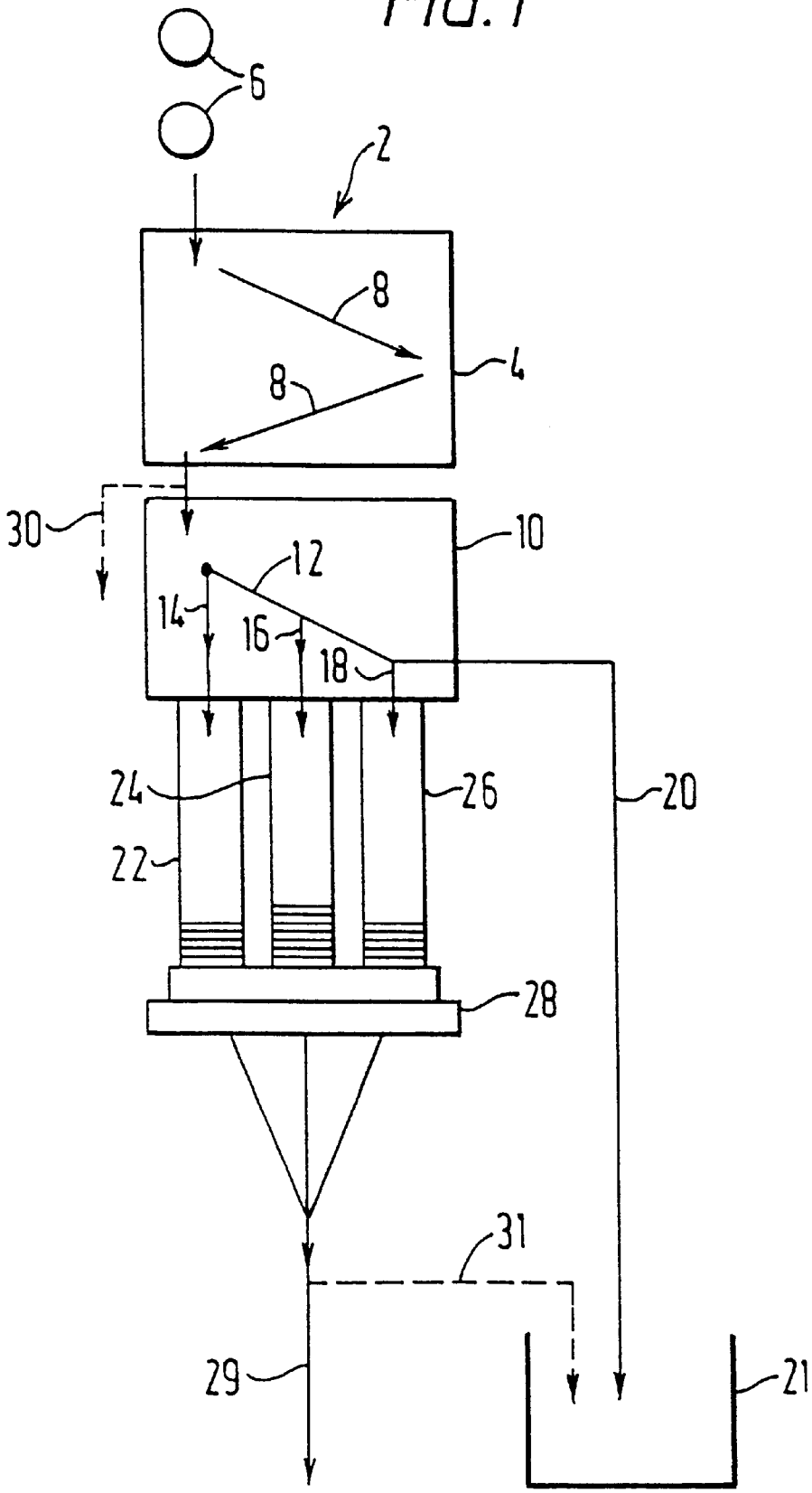
FIG. 1 is a schematic diagram of the mechanical part of a coin handling apparatus in accordance with the invention.

Referring to FIG. 1, the coin handling apparatus 2 includes a coin validator 4 for receiving coins as indicated at 6. During the passage of the coins 6 along a path 8 in the validator 4, the validator provides signals indicating whether the coins are acceptable, and if so the denomination of the coins.

Acceptable coins then enter a coin separator 10, which has a number of gates (not shown) controlled by the circuitry of the apparatus for selectively diverting the coins from a main path 12 into any of a number of further paths 14, 16 and 18, or allowing the coins to proceed along the path 12 to a path 20 leading to a cashbox 21. If the coins are unacceptable, instead of entering the separator 10 they are led straight to a reject slot via a path 30.

Each of the paths 14, 16 and 18 leads to a respective one of three coin tubes or containers 22, 24 and 26. Each of these containers is arranged to store a vertical stack of coins of a particular denomination. Although only three containers are shown, any number (and preferably at least four) may be provided.

A dispenser indicated schematically at 28 is operable to dispense coins from the containers when change is to be given by the apparatus. The dispensed coins are delivered to a refund path 29.

Referring to FIG. 2, the circuit of the present embodiment of the invention incorporates a microprocessor 50 connected to data and address buses 52 and 54. Although separate buses are shown, data and address signals could instead be multiplexed on a single bus. A bus for control signals could also be provided.

The microprocessor 50 is connected via the buses 52 and 54 to a read-only memory (ROM) 56 and a random access memory (RAM) 58. The ROM 56 stores the program controlling the overall operation of the microprocessor 50, and the RAM 58 is used by the microprocessor 50 as a scratch-pad memory.

The microprocessor 50, the ROM 56 and the RAM 58 are, in the preferred embodiment, combined on a single integrated circuit.

The microprocessor 50 may also be connected via the buses 52 and 54 to an EAROM 60 for storing a variety of alterable parameters.

The microprocessor 50 is also coupled via the buses 52 and 54 to input/output circuitry indicated at 62. The circuitry 62 includes user-operable switches, at least one level sensor for each of the coin containers 22, 24 and 26, circuits for operating the dispenser 28 and the gates of the coin separator 10, the circuitry of the coin validator 4, a display visible to a user of the apparatus for displaying an accumulated credit value and an "exact change" indication when insufficient coins are stored to guarantee that change will be available, and a further display visible to a serviceman on opening a vending machine 64 in which the apparatus 2 is mounted.

The input/output circuitry 62 also includes an interface between the control circuit of the apparatus and the vending machine 64 to which it is connected, and a further interface to an audit device 66.

In operation of the apparatus, the microprocessor 50 successively tests the signals from the validator to determine whether a coin has been inserted in the apparatus. When a credit has been accumulated, the microprocessor also tests signals from the vending machine to determine whether a vending operation has been carried out. In response to various signals received by the microprocessor 50, various parts of the program stored in the ROM 56 are carried out. The microprocessor is thus arranged to operate and receive signals from the level sensors of the coin containers 22, 24 and 26, and to control the gates in the separator 10 in order to deliver the coins to the required locations, and is also operable to cause appropriate information to be shown on the displays of the apparatus and to deliver signals to the vending machine to permit or prevent vending operations. The microprocessor is also operable to control the dispenser to deliver appropriate amounts of change. Preferably, the microprocessor is operable to determine combinations of denominations to dispense as change in such a way as to take into consideration expected future change requirements, e.g. as set out in EP-A-0 729 624 or EP-A-0 986 031.

The audit device 66 maintains a record of the number of coins of each denomination received and dispensed by the apparatus.

The arrangement so far is known, and the details of particular structures suitable for using as various parts of the mechanism will therefore not be described in detail.

The particular sequence of most of the operations carried out by the microprocessor may be the same as in previous apparatus. A suitable program to be stored in the ROM 56 can therefore be designed by anyone familiar with the art, and accordingly only the operations carried out by the particularly relevant parts of this program will be described.

The present embodiment consists of a modification of the arrangement described in connection with EP-B-0 076 640. As in the arrangement disclosed therein, the microprocessor is arranged to maintain counts representing the numbers of coins in the respective containers 22, 24 and 26. Each count is updated in response to further coins being delivered to or dispensed from the respective container.

One of the containers is shown schematically in FIG. 3. Although FIG. 3 shows the container 24, the other containers are substantially identical. The container has an upper level sensor and a lower level sensor. The upper level sensor in this embodiment is an optical sensor comprising a light-emitting device 40, and a light responsive sensor 42. Similarly, the lower sensor comprises a light emitting device 44 and a sensor 46. If the level of coins in the container reaches either of the level sensors, the light path from the respective device to the sensor will be obscured, and this is detected by the microprocessor. Whenever the level of coins changes in such a manner as to block or open the light path of a respective sensor, the coin count for that container is, if necessary, corrected in a predetermined manner, in a way which is analogous to the technique used for the single sensor described in EP-B-0 076 640. If desired, a single level sensor could be used in the present embodiment in place of the upper and lower level sensors.

When the level of coins rises so that the upper level sensor light path has just become blocked, the coin count is set to a value UR which, as indicated in FIG. 3, represents the level of the upper sensor. Similarly, if the level of coins drops so that the light path of the lower sensor is cleared, the coin count for the container is set to a value equal to the lower level sensor level LR (as indicated in FIG. 3) minus 1.

The values UR and LR may be alterable values, for example stored in the EAROM 60. The values LR and UR would for example be altered if the container were to be used for different denomination coins having different thicknesses, so that the number of coins required to reach the lower or upper level sensor would be different.

The microprocessor 50 is operable to allow coins to be dispensed from the container 24 whenever the coin count exceeds a predetermined level S, which is preferably less than LR, and which may also be an alterable value stored in the EAROM 60. The value S may be set to zero, although in the preferred embodiment it is set to a small number because it is found that dispensing of coins becomes less reliable as the last few coins from a container are being dispensed.

The circuitry 62 includes one or more switches which can be operated by a serviceman to select between three modes of the apparatus. These modes are referred to herein as the "float up" mode, the "float down" mode and the "float quick" mode.

In the float up mode, any coins of a denomination stored by the container 24 are directed to the tube 24 unless the number of coins in the tube is equal to or greater than an upper level FU. FU is a variable value, preferably stored in the EAROM 60. A typical range over which the level FU may vary is indicated at VR in FIG. 3. It will be noted that this range extends over a substantial proportion of the upper part of the container 24. FU should not exceed a maximum limit M, above which jamming of the apparatus may occur. This level M may also be an alterable parameter, for example stored in EAROM 60. The level M is preferable at or slightly below the level UR of the upper sensor. The upper sensor would be brought into use if the tube is manually refilled to a level exceeding the upper level sensor.

In the following, it will be assumed that the containers store N denominations, 1 . . . N, and any variable relating to a denomination will be labelled with a subscript, e.g. 1, representing the denomination.

In the float up mode of operation, whenever a serviceman services the machine, the cashbox 21 is emptied. Each of the coin containers is first preferably replenished (preferably using coins from the cashbox) by feeding coins into the validator in the normal way until the level of coins reaches $FU_i$, any excess coins then being automatically redirected to the cashbox. Lowering the values $FU_i$ thus reduces the amount of cash stored in the machine, but also reduces the amount of change available for dispensing.

Preferably, the display visible to the serviceman on opening of the vending machine is operable to provide an indication of whether replenishing is required, and desirably this indication will indicate which container or containers need replenishing (thus implicitly indicating which denominations are required).

Periodically, for example once a week, the microprocessor 50 is operable to use data stored by the audit device 66 to alter each of the levels $FU_i$. The data is representative of the extent to which denominations have been required for giving change.

For example, the microprocessor may use the total number $I_i$ of coins received by the apparatus which are stored in a container, and the total number $O_i$ of coins of the same denomination which are dispensed from the container, during the course of a predetermined number n (e.g. 1000) of transactions. These numbers can be successively calculated after every n transactions, the most recent values then being used, or they could be rolling values updated after every transaction. Preferably, any transactions carried out in circumstances when the "exact change" indication is activated are ignored, as the operation in these circumstances may be untypical.

The microprocessor may be arranged to calculate a new upper level $FU_i$ using for example an algorithm which ensures that for each of the possible pairs of denominations i,j:

$$FU_i:FU_j \approx O_i^2/I_i:O_j^2/I_j \tag{1}$$

and which ensures that:

$$\sum_{i=1}^{N} FU_i \cdot V_i \text{ is at least approximately equal to } TV \tag{2}$$

wherein $V_i$ is the value of the denomination i, and TV is the desired total value of all the coins stored in the containers following the float operation.

For each denomination, the value $O_i/I_i$ represents the ratio between the number of coins received and the number dispensed. The higher this value, the greater the risk of running out of change and thus the higher the float value should ideally be set. However, it would be preferable to give a greater weight to denominations which are used more frequently, i.e. which are associated with a large value of $O_i$. Accordingly, the float level is set to be proportional to:

$$O_i \times O_i/I_i = O_i^2/I_i$$

Assuming $R_i = O_1^2/I_i$, then each float level can be calculated from:

$$FU_i = R_i \cdot TV \Big/ \sum_{i=1}^{N} R_i \cdot V_i$$

Thus, the float level for a denomination will tend to be higher (at the expense of float levels for other denominations) if the ratio of dispensed to stored coins is high and the number of coins dispensed is also high. On the other hand, if the usage is low, or if many coins are sent to the store, the level $FU_i$ is set at a lower level, which reduces the amount of cash of that denomination retained in the machine, and enables more coins of other denominations to be retained.

The float levels actually used will be approximations because of rounding. However, preferably at least one float level (preferably that associated with the lowest denomination) is adjusted to take into account these approximations, so that the total amount stored is exactly equal to TV.

Taking one example, it is assumed that TV=£10 (=1000 p) and that coins of the denominations 50 p, 20 p, 10 p and 5 p are stored. Assume also for simplicity that the ratio $O_i/I_i$ is equal to 2 for all denominations, but the values $O_i$ are, respectively, 100, 200, 500 and 200. This gives the following float levels:

50 p: 200×1000/(30000)=6.67, rounded to 7 (=£3.50)
20 p: 400×1000/(30000)=13.3, rounded to 13 (=£2.60)
10 p: 1000×1000/(30000)=33.3, rounded to 33 (=£3.30)
5 p: 400×1000/(30000)=13.3, adjusted to 12 (=£0.60) to give a total of £10.

When a serviceman services the machine, he feeds coins taken from the cashbox into the machine until they are sent to the cashbox because all the containers are filled to their respective upper levels, and then empties the cashbox. If desired, this could be done after the serviceman has operated switches to put the machine into a float mode. In this mode, the insertion of coins does not influence the records of genuine transactions kept by the audit device 66.

The switches of the circuitry 62 can be operated by a serviceman to change the value TV.

The float down mode differs from the float up mode as described in the following.

In the float down mode, the microprocessor allows coins to be directed to each container so long as the number of coins in the container does not exceed the maximum number $M_i$.

When a serviceman services the machine, he operates a particular combination of switches in the circuitry 62 to perform a float operation, which causes an automatic dispensing action whereby coins are successively dispensed from each container until the level decreases to a predetermined float level $FD_i$. The values $FD_i$ are variables which may also be stored in the EAROM 60. The values may be stored in the same memory locations as are used to store the values $FU_i$, the stored values representing $FU_i$ in the float up mode and $FD_i$ in the float down mode.

Preferably, this service operation also takes place in a special float mode, so that servicing operations do not influence the audit records of genuine transactions. Also, the float mode may cause the microprocessor to inhibit the delivery of coins to the containers unless the level in the container is below $FD_i$. This would permit the serviceman to replenish any containers with lower levels in an automatic manner, the microprocessor automatically rejecting or directing to the cashbox any surplus coins fed to the containers. Preferably, as in the float up mode, a display indicates whether replenishment is required, and preferably which containers require replenishment.

FIG. 3 shows at LR a typical range over which the value $FD_i$ may vary. It will be noted that this is located near the bottom of the container 24, but this is not necessary and the range could extend over a higher area, and could overlap the range VR.

Preferably, as the coins are being automatically dispensed during the float operation, a gate (not shown) is operated either manually or automatically so that the coins are not refunded to the user along path 29 (FIG. 1) but are instead delivered along a path 31 to the cashbox 21.

After the automatic dispensing operation has taken place using all the containers, the cashbox 21 is emptied. This mode thus has the advantage compared with the float up mode that the total amount of cash retained in the machine can be kept relatively low, while nevertheless allowing the number of coins in each tube to become relatively high during use, so as to improve change availability.

Periodically, the microprocessor recalculates the values $FD_1$, using information from the audit device 66 in the same way as the recalculation of $FU_1$. Thus:

$$FD_i = R_i \cdot TV \Big/ \sum_{i=1}^{N} R_i \cdot V_i$$

The algorithms described above for calculating $FU_i$ and $FD_i$ can be varied in many ways. For example, the algorithm could be arranged to determine whether, for any denomination, $O_i/I_i<1$, indicating that the corresponding store is on average becoming replenished. If so, the float level $FU_1$ or $FD_i$ can be set to a low level, allowing a greater number of coins of other denominations to be stored. Another possibility would involve finding out which is the denomination that most requires an increase in float level and the one which most requires a decrease in float level and then increasing the float level for the first by n units and decreasing the float level for the other by m units, with m and n chosen to be the minimum quantities which give corresponding values.

The float quick mode is similar to the float down mode except for the calculation of the $FD_i$ values. In the float quick mode, the microprocessor calculates the difference between the total value of the coins currently stored in all the containers and the value TV. If the difference is positive, the microprocessor issues instructions to dispense sufficient coins to reduce the currently-stored total value to TV. This can be achieved using the same technique, and preferably the same algorithm, as is used for calculating and dispensing change. The result of this is that, if possible, the float operation will be performed without requiring replenishment. Depending on the change algorithm, if there is a choice of different combinations to retain in the store, this choice will be made on the basis of maximising change availability or reducing the number of coins being dispensed.

If, on the other hand, the currently-stored total value is less than TV, then preferably an indication is provided to the serviceman to deposit more coins in the apparatus (the indication preferably showing which denominations are preferred). This indication disappears as soon as the total value becomes equal to or exceeds TV, any excess value then being refunded, preferably to the cashbox, using the usual change algorithm.

This mode therefore provides in general the quickest way of carrying out the float operation, particularly if any necessary replenishment is carried out using high-denomination coins.

Switch means may be provided for disabling the recalculation of the values $FU_1$ and/or $FD_i$.

In an alternative embodiment, there is provided a means, such as a further microprocessor, for carrying out the recalculation of $FU_i$ and/or $FD_i$ separately from the microprocessor 50. This recalculating means may be supplied separately from the apparatus, for connection thereto as an optional accessory. It may form part of the audit device 66, which itself may be provided as a separate, connectable device.

The above-described float down and float quick modes could be varied so that coins are delivered to containers until the levels reach $FU_i$, these $FU_1$ values possibly being variable and possibly automatically recalculable.

In the above arrangement recalculation of the values $FU_i$ or $FD_i$ takes place periodically and automatically. Instead, recalculation may take place in response to a manually-effected instruction, e.g. from a serviceman. This is the preferred arrangement for the float down and float quick modes, because the $FD_i$ values are only needed during the float operation, and thus recalculation could be effected in response to the serviceman instructing the float operation.

It may be desirable to set a lower limit to the float levels if it is found, for example, that dispensing problems arise with tubes containing very few coins. Such a lower limit would override any calculated level.

It will be appreciated from the foregoing that the control means needs to be capable of determining different combinations of coins which have a collective value equal to a predetermined value. However, in any given set of conditions, the control means may be arranged to determine only a single combination and to carry out the float operation accordingly. Alternatively, the control means may respond to a set of circumstances by determining several different combinations and then selecting one for use in the float operation. Preferably, the control means operates by calculating appropriate combinations, but it could instead operate by means of a look-up table which sets out the appropriate combination to select for different conditions.

What is claimed is:

1. Currency handling apparatus comprising a store for storing units of currency of different denominations, means for selectively directing currency units to the store, means for selectively dispensing units from the store and control means which can be enabled by an operator in a float operation automatically to discharge currency units from the store and/or to prevent units from being directed to the store, the control means being capable of determining different combinations of currency units of different denominations which have a collective value equal to a predetermined value, and controlling at least one of the dispensing means and directing means so as to leave in the store currency units corresponding to a said combination.

2. Apparatus as claimed in claim 1, wherein the control means is operable to determine combinations of currency units which are not restricted to combinations formed from the presently-stored currency units.

3. Apparatus as claimed in claim 2, wherein the control means is operable to provide an indication that a particular determined combination to be left in the store after the float operation requires one or more coins in addition to those present in the store.

4. Apparatus as claimed in claim 3, wherein the indication indicates the denominations of required additional currency units.

5. Apparatus as claimed in claim 1, wherein the control means is operable to determine a particular combination of currency units to be left in the store in accordance with one or more parameters indicative of the likelihood of currency units of respective denominations being required for dispensing.

6. Apparatus as claimed in claim 5, when the control means is operable to determine said particular combination in response to detection of any one or more of the following parameters:

(a) the set of denominations which can be accepted by the apparatus;

(b) the set of denominations which can be dispensed by the apparatus;

(c) data indicative of the relative population levels of respective currency denominations in the area in which the apparatus is to be used;

(d) the number of currency units of respective denominations which have been received by the apparatus;

(e) the number of currency units of respective denominations which have been dispensed by the apparatus;

(f) the way in which currency units of particular denominations have been routed by the apparatus;

(g) price data representative of the price of products or services obtained by supplying currency units to said apparatus; and (h) detection of "insufficient change" situations, wherein the apparatus cannot dispense adequate change because of depletion of one or more denominations.

7. Apparatus as claimed in claim 6, wherein the control means is operable to determine said particular combination in response to a relationship between the number of received currency units of each denomination which have been directed to the store and the number of received currency units of said denominations which have been dispensed from the store.

8. Apparatus as claimed in claim 1, wherein the control means is operable to determine a particular combination of currency units to be left in the store in dependence upon the numbers of currency units of respective denominations in the store before the float operation.

9. Apparatus as claimed in claim 8, wherein the control means is arranged to determine preferentially a combination which comprises currency units of respective denominations in numbers no greater than those in the store prior to the float operation, so as to avoid the need for replenishment.

10. Apparatus as claimed in claim 9, wherein the control means is operable to select a particular combination from a plurality of combinations none of which require replenishment.

11. Apparatus as claimed in claim 10, wherein the selection is performed in such a way as to minimise the number of coins discharged in the float operation.

12. Apparatus as claimed in claim 10, wherein the selection is performed in response to one or more parameters indicative of the likelihood of currency units of respective denominations being required for dispensing.

13. Apparatus as claimed in claim 1, further comprising a cashbox, the means for selectively directing currency units being operable to direct the units selectively either to the store or to the cashbox.

14. Apparatus as claimed in claim 13, including means for directing the currency units discharged from the store during the float operation to the cashbox.

15. Apparatus as claimed in claim 1, including switch means for switching the apparatus between at least first and second modes, each of which modes differently influences the control means in its determination of a particular combination of currency units to be left in the store after the float operation.

* * * * *